US006173507B1

(12) United States Patent
Catallo

(10) Patent No.: US 6,173,507 B1
(45) Date of Patent: Jan. 16, 2001

(54) ARRANGEMENT AND OPERATION OF IMPROVED DRYER BETWEEN SHRINKAGE COMPACTORS TO CONTROL RESIDUAL SHRINKAGE OF WET KNITTED WEB TO BELOW THAT PRODUCED BY TUMBLE DRYING

(76) Inventor: Frank Catallo, 84 Wheatley Rd., Old Westbury, NY (US) 11568

( * ) Notice: Under 35 U.S.C. 154(b), the term of this patent shall be extended for 0 days.

(21) Appl. No.: 09/372,745

(22) Filed: Aug. 11, 1999

Related U.S. Application Data

(63) Continuation-in-part of application No. 08/812,043, filed on Mar. 6, 1997.

(51) Int. Cl.[7] ..... F26B 5/14

(52) U.S. Cl. ..... 34/397; 34/397; 34/398; 34/438; 34/459; 34/203; 34/207; 34/216; 26/18.5; 26/18.6

(58) Field of Search ..... 34/202, 203, 207, 34/208, 209, 216, 217, 397, 398, 400, 437, 438, 444, 451, 459; 26/18.5, 18.6

(56) References Cited

U.S. PATENT DOCUMENTS

| | | | | |
|---|---|---|---|---|
| 3,007,223 | * | 11/1961 | Wehrmann | 26/18.6 |
| 4,363,161 | * | 12/1982 | Catallo | 26/18.6 |
| 4,622,728 | * | 11/1986 | Bumuller et al. | 26/18.5 |
| 4,872,383 | * | 10/1989 | Niwa et al. | 83/175 |

* cited by examiner

*Primary Examiner*—Pamela Wilson
(74) *Attorney, Agent, or Firm*—Charles E. Baxley

(57) ABSTRACT

Apparatus and a related method control within acceptable limits, of less than two percent (2%), residual shrinkage in garments to be made from a knitted fabric web or other fabrics subject to high shrinkage. The knitted fabric web is passed continuously in a moist condition through a first shrinkage compactor. Then the web is carried on an endless belt through a special dryer in a relaxed condition to allow loops of knits to shorten. The web is caused to wave in the dryer. The web is then conveyed through a second shrinkage range for final shrinking to a desired weight per surface area with less than two percent (2%) residual shrinkage. Thus the garments are safe from further shrinking in home tumble dryers.

13 Claims, 6 Drawing Sheets

ARRANGEMENT AND OPERATION OF IMPROVED DRYER BETWEEN SHRINKAGE COMPACTORS TO CONTROL RESIDUAL SHRINKAGE OF WET KNITTED WEB TO BELOW THAT PRODUCED BY TUMBLE DRYING

CROSS-REFERENCE TO RELATED APPLICATION

This Application is a continuation-in-part Application with respect to my co-pending parent application Ser. No. 08/812043 which had been filed on Mar. 6, 1997.

BACKGROUND OF THE INVENTION

1. Field of the Invention

When knitted fabric is produced and is bleached, dyed or otherwise treated it generally emerges in tubular form, twisted like a rope, and in a wet condition. Residual shrinkage in the fabric for manufacture of garments must be controlled within acceptable limits. Tumble dryers are popular in homes and they present a difficult challenge to residual shrinkage in knitted garments. Washing and tumble drying of knitted garments at home normally eliminates about ninety-eight percent (98%) of all potential knit shrinkage, yielding two percent (2%) of residual shrinkage. So if a culprit knitted fabric has more than two percent (2%) of residual shrinkage, trouble brews. After a garment is manufactured from the culprit fabric, when a consumer washes it and puts it into his or her tumble dryer, a moment of truth arrives. The tumble dryer further shrinks the garment down to two percent (2%) residual shrinkage: The garment reduces in size and is apt to fit its wearer like a sausage in its casing.

A garment manufacturer can compensate for anticipated excess residual shrinkage by oversizing garments so as to be ready for tumble dryer shrinkage. But an oversized garment then does not fit properly before it is washed and tumble dried. Further the oversized garment frequently becomes distorted because its shrinkage cannot be controlled uniformly throughout.

In producing and treating wet knitted fabrics many attempts have been made to control residual shrinkage in garments made therefrom by duplicating conditions of the tumble dryer in production of the fabric. Yet action of the tumble dryer on a garment, which in essence is a short piece of the fabric, differs from action on a long web of the fabric which travels continuously through an industrial knitting and/or converting mill. Even though prior industrial dryers have improved, in response to the tumble dryer challenge, the prior art industrial dryers still do not reduce residual shrinkage as much as a consumer's tumble dryer at home does on finished garments.

Another approach to control of residual shrinkage in the garment comprises compacting the fabric when it is almost dry. However such strategic almost-dry compacting can be difficult to perform, particularly when significant shrinkage has to be achieved. When performing the strategic almost-dry compacting the fabric has to be handled very carefully to prevent fall-out of the shrinkage prior to cutting.

OBJECTS AND SUMMARY OF THE INVENTION

The foregoing disadvantages of prior approaches to control residual shrinkage of knitted fabrics are substantially overcome by the present invention. A pair of compactors is separated each from the other by a special dryer that itself achieves a very significant shrinkage through shortening loops of the knit fabric. The fabric moves through the special dryer while in a relaxed tension-free condition to allow the loops of the fabric knits to shorten by coming together and thereby reduce very substantially the fabric residual shrinkage. Waving of the fabric in the dryer also contributes to shortening loops of the fabric knits. The compactors preferably comprise first one with multiple belts providing shrinkage of relatively wet fabric prior to its entry into the special dryer and after the fabric is discharged from the special dryer it is delivered to another compactor usually of a double-roll type for accurate final compaction. Thus the knitted fabric is provided with an acceptable residual shrinkage, less than two percent (2%), and is ready for garment cutting or other finishing that may be appropriate. The problem of unacceptable residual shrinkage, over two percent (2%), in the knitted fabric has been eliminated. Garments made from the knitted fabric become tumble-dryer shrinkage proof.

Accordingly one object of the present invention is to control within acceptable limits residual shrinkage in garments made from knitted fabrics.

A further object of the present invention is to simulate in an industrial knitting mill action of a home tumble dryer for pre-shrinking knitted fabrics, or other similar fabrics, subject to a high degree of shrinkage.

A still further object of the present invention is to employ to their best advantage commercially available and reliable equipment items, along with the special dryer, which all cooperate in an optimal sequence so as to achieve desired control of residual shrinkage in garments made from knitted fabrics.

A still further object of the present invention is to conclude the finishing process with improved accuracy and reliability of residual shrinkage of the knitted fabrics.

A still further object of the present invention is to provide a finishing line of equipment that is safe, efficient, easy to operate and repair, and well suited to its intended task.

The foregoing and other objects and advantages of the present invention will appear more clearly hereinafter.

In accordance with the present invention there is provided an arrangement of apparatuses and a related method.

DETAILED DESCRIPTION OF THE DRAWINGS

Further characteristics and advantages of the present invention will be understood more readily from a detailed description which follows with reference to the accompanying drawings wherein same numerical designations refer to like items throughout and in which:

FIGS. 1A and 1B together comprise a diagrammatic side elevational view of a finishing line for a knitted fabric, or similar fabric susceptible of a high degree of shrinkage, contemplated herein and showing a double belt shrinker such as is taught by U.S. Pat. No. 3,007,223 to Wehrmann, a special dryer as taught herein, and a compactor of the double-roll type as taught by Catallo in U.S. Pat. No. 4,363,161;

FIGS. 2A and 2B together comprise a top plan view of the finishing line of FIG. 1;

DETAILED DESCRIPTION OF THE INVENTION

The present invention provides a method and a related arrangement of continuous process apparatuses to control within acceptable limits residual shrinkage in garments made from knitted fabrics and like fabrics which are subject to severe shrinkage.

Figure 1A:
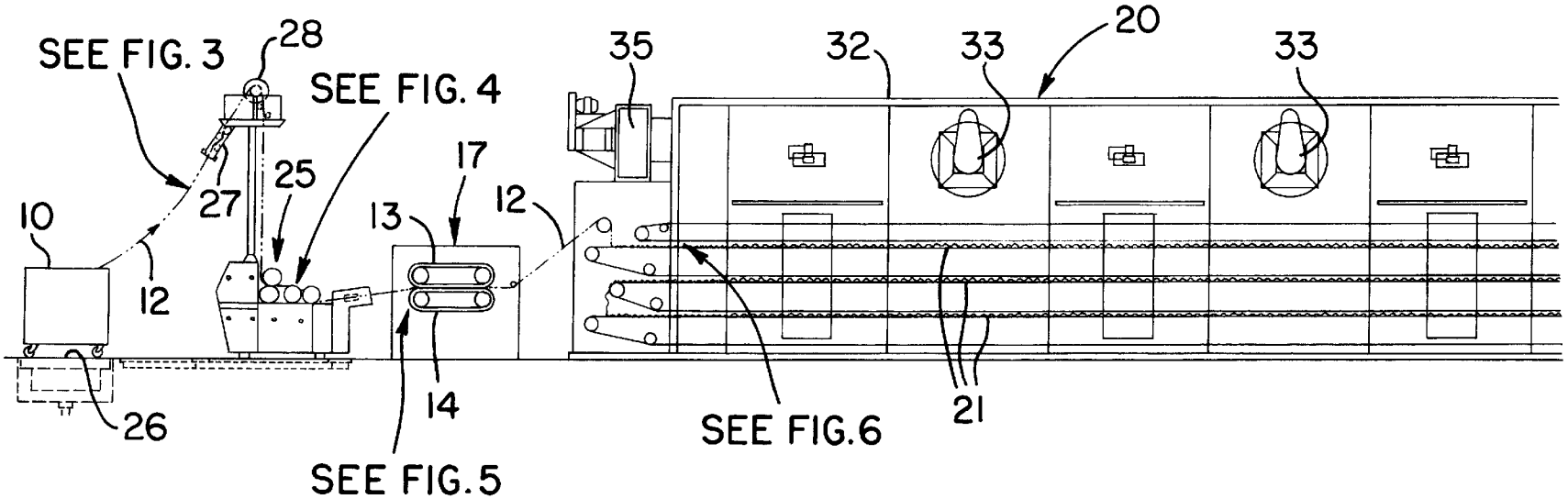
Figure 1B:
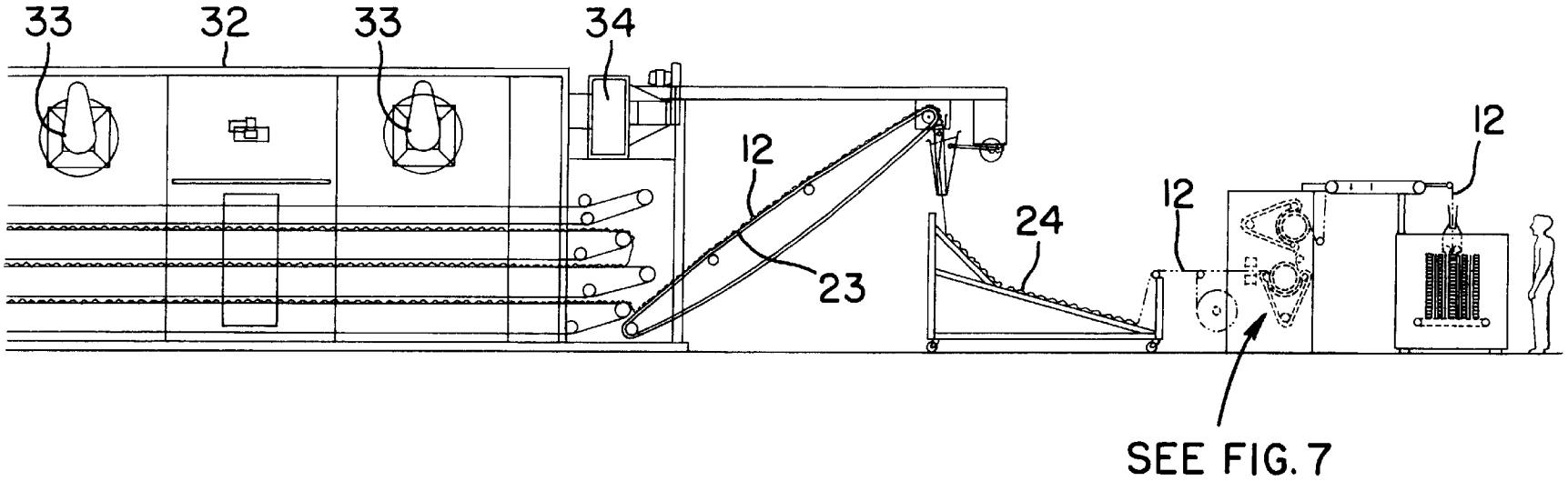
Figure 2A:
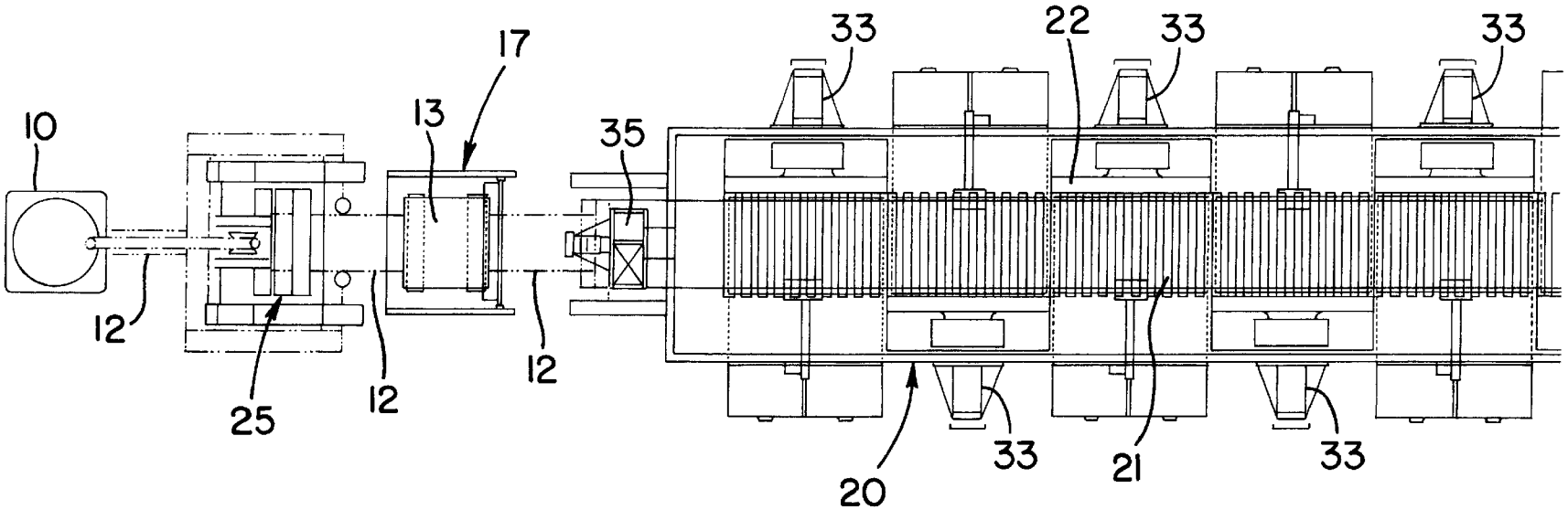
Figure 2B:
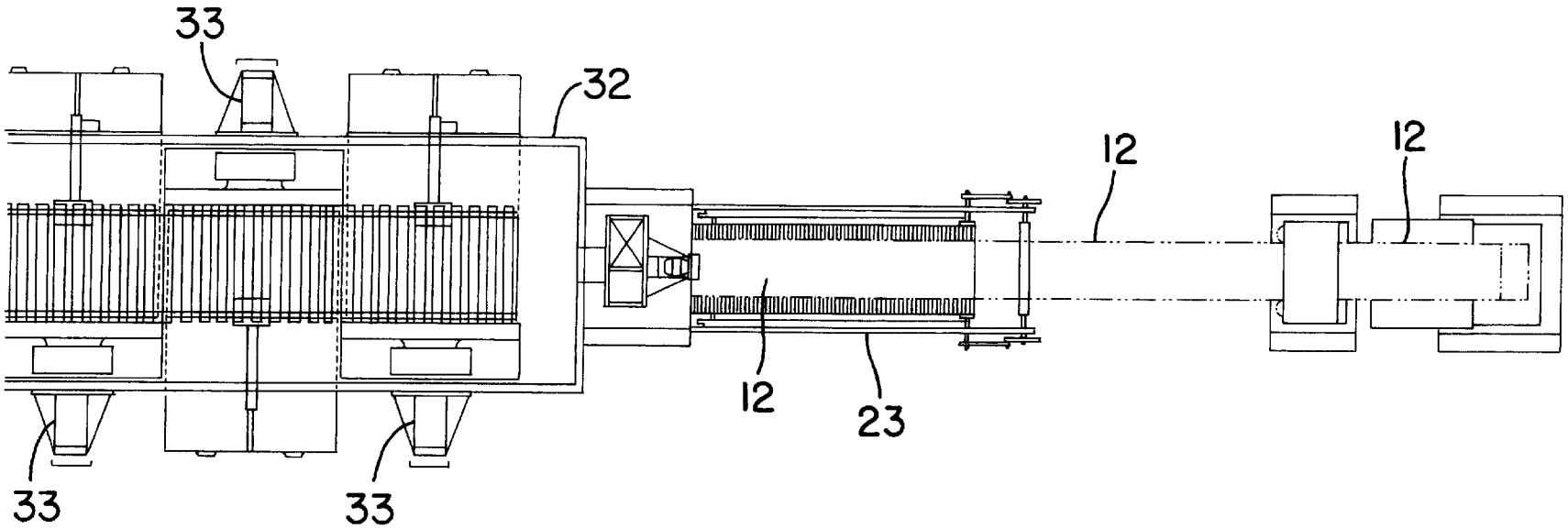
Figure 3:
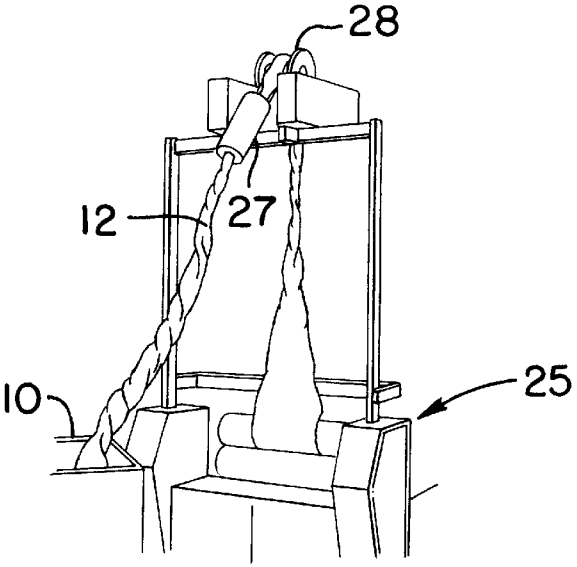
FIG. 3 is an illustrative sketch showing delivery of a wet knitted fabric web to the initial double-belt compactor.

As shown in FIGS. 1 and 3 a wet knitted fabric tube 12 is usually twisted with a maximum moisture content usually comes from a dye tub or a bleaching range and is delivered in the form of a twisted tube from a handling truck 10 via a well-known detwister, tube slicer (optional), spreader and moisture extractor generally designated 25 whereby its moisture content usually is reduced to between 50% and 20% by weight but could be as high as 65% or as low as 15%.

Figure 4:
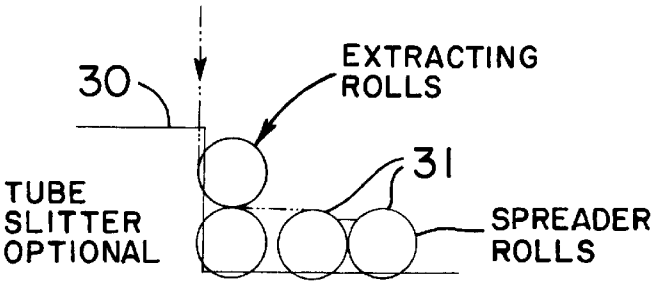
FIG. 4 is an illustrative sketch detailing moisture extraction from the web.
Figure 5:
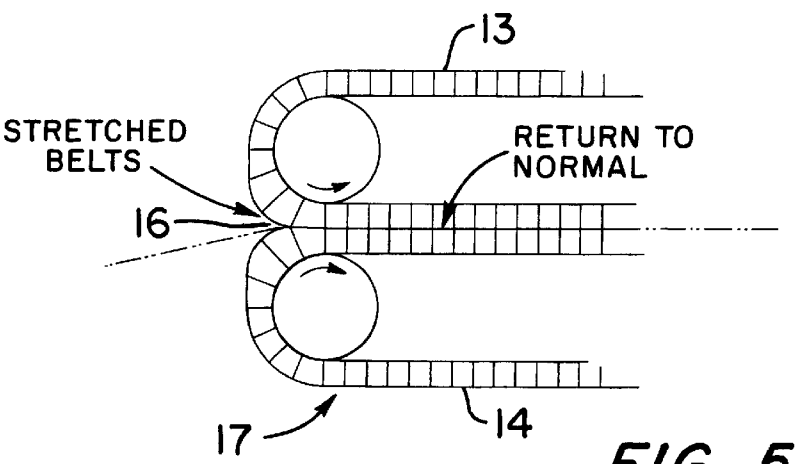
FIG. 5 is an illustrative sketch detailing action of the double-roll type compactor.

In the detwisting operation illustrated in FIGS. 1 and 3 the handling truck 10 is mounted on a rotatable platform 26 seen in FIG. 1. The knitted tube 12 is drawn through twist sensing means 27 so as to pass in straight alignment over an elevated saddle 28. A typical detwister is shown and explained fully in Applicant's U.S. Pat. No. 5,718,107. The twist sensing means 27 causes the rotatable platform 26 to rotate with the truck thereon so as to untwist the tube 12 of knitted fabric. In the spreader, slicer and moisture extractor (generally designated 25) the tube 12 of knitted fabric is squeezed between extracting rolls 29 shown best in FIG. 4. The tube can be treated alternately as a double-width flattened tube or it can be slit by a slicing knife 30 for further treatment in the form of an open width fabric. Spreader rolls 31 also are provided for delivery of the tube, here presumed to be in an open-width form for shrink-proofing. Such detwisting, spreading, tube slicing and moisture extraction are well known in treatment of knitted textile fabrics. Such equipment is available commercially from Fab-Con Machinery Development Corp. in Port Washington, N.Y. The usually opened and flat fabric then is fed by conventional input means into an initial compactor generally designated 17 and preferably having a pair of opposed compacting belts 13, 14 for compaction in a nip 16 formed therebetween as taught in the Wehrmann U.S. Pat. No. 3,007,223.

From the twin belted compactor 17 the fabric is transported by dryer delivery means to the special dryer generally designated 20 that operates with the fabric 12 in a relaxed tension-free condition so that knit loops of the knitted web are allowed to close toward each other to shorten the loops and there is no tension distortion of the knitted fabric as it is being dried therein. In the dryer 20 the fabric 12 is carried on one or more endless belts 21 and the fabric 12 is overfed so that it is even more relaxed. Opposing nozzles 22 are arranged above and below the fabric 12 and staggered so that they induce a waving action into the knitted fabric web. In the dryer 20 the fabric is dried to a moisture content of from 10% to 0%.

Figure 6:
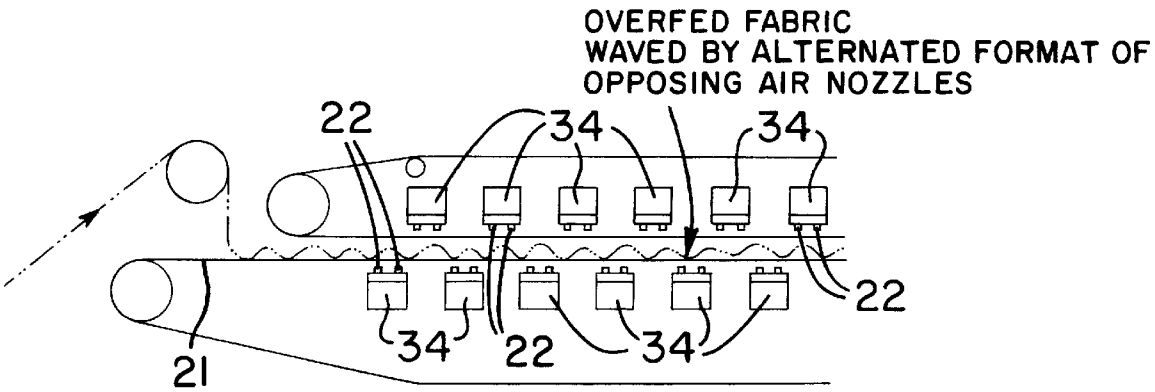
FIG. 6 is an illustrative sketch detailing action in the special dryer of the present invention, particularly relaxing and causing waving of the fabric web to produce shrinkage by allowing knit loops of the knitted fabric to come together and thereby shorten.
Figure 7:
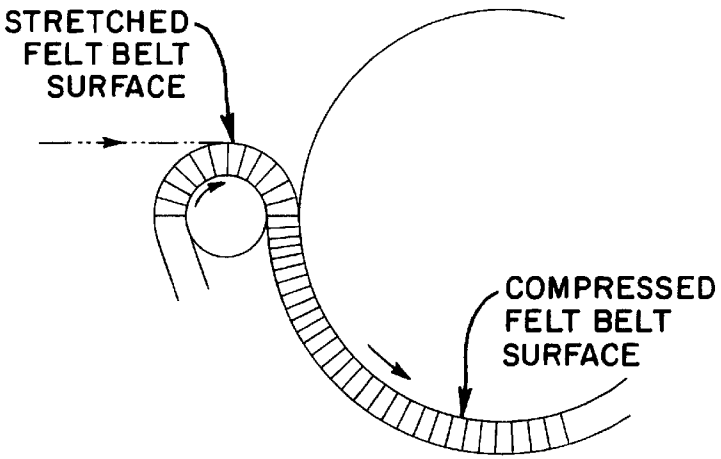
FIG. 7 is an illustrative sketch detailing action of the precise finishing compactor.

The special dryer is shown in FIG. 1 and illustrated in FIG. 6 and comprises a generally box-like housing 32 with heaters 33 communicating in flow series with plenums 34 to deliver heated gas (air) to the nozzles 22. Instead of using heaters, hot gas may be received from any convenient and available source. The present heater is special in part because the nozzles 22 are arranged, as best seen in FIG. 6, spaced above and below the fabric in alternate format to induce a waving motion thereto. The hot gas is then exhausted via a vent 35. Heat from the exhausted gas may be used to preheat air for the heaters 33. From the dryer 20 the fabric is transported, also in a relaxed state, by conveying means shown as a conveyor 23 and a scray 24 to a compactor of a two-roll type taught in Catallo U.S. Pat. No. 4,363,161 for final shrinking.

By this particular series of apparatuses, particularly the special dryer 20, and following the method outlined herein, I am able to obtain substantial benefits in shrinkage control for knitted fabrics and to enable manufacture of garments which have less residual shrinkage than by prior art apparatuses and methods. Knitted fabrics, and other fabrics susceptible to a high degree of shrinkage, finished as taught herein, are able to be tumble dried at home without further shrinkage. Stated differently, the tumble dryer challenge has been met.

It will be apparent to those skilled in the art of processing knitted fabrics that deviations may be made from the foregoing preferred embodiment without departing from a main theme of invention as set forth in claims which follow.

I claim:

1. Apparatus for controlling within acceptable limits residual shrinkage in garments to be made from a flattened knitted fabric web having two sides, the apparatus comprising in combination:

input means for delivering the knitted fabric web continuously at a moisture content of from 65% to 15% by weight to a first shrinkage compactor for shrinking therein;

dryer delivery means for delivering the knitted fabric web in a relaxed condition to a dryer, the dryer including a housing, a source of heated air, ducting for delivering the heated air from the source of heated air to a series of nozzles, an exhaust means, and an endless belt adapted to carry the knitted fabric web in a relaxed condition free from longitudinal and transverse tension along a path through the dryer to allow loops of knits to shorten and to dry the knitted fabric web to a moisture content of from 10% to 0% by weight;

the series of nozzles arranged above and below the fabric web in alternating format, thereby directing the heated air onto either side of the two sides of the knitted fabric web to cause the knitted fabric web to wave still in the relaxed condition;

conveying means for carrying the knitted fabric web still in the relaxed condition from the dryer to a second shrinkage compactor, the second shrinkage compactor arranged for final shrinkage of the knitted fabric web to a desired weight per surface area with less than 2% residual shrinkage.

2. Apparatus for controlling within acceptable limits residual shrinkage in garments to be made from a knitted fabric web having two sides, the apparatus comprising in combination:

input means for delivering the knitted fabric web continuously at a moisture content of from 50% to 20% by weight to a first shrinkage compactor;

the first shrinkage compactor including twin belts abutting one another to form a nip therebetween wherein the fabric web is compacted for initial shrinking;

dryer delivery means for delivering the knitted fabric web to a dryer which includes a housing, a source of heated air, ducting for delivering the heated air from the source of heated air to a series of nozzles exhaust means, and an open mesh endless belt adapted to carry the fabric web in a relaxed condition free from longitudinal and transverse tension along a path through the dryer to allow loops of knits to shorten and to dry the knitted fabric web to a moisture content of from 10% to 0% by weight;

the series of nozzles arranged above and below the fabric web in alternating format, thereby directing the heated air onto either of the two sides of the knitted fabric web to cause the knitted fabric web to wave still in the relaxed condition;

conveying means for carrying the knitted fabric web still in the relaxed condition from the dryer through a second shrinkage compactor;

the second shrinkage compactor arranged for final shrinking of the knitted fabric web to a desired weight per surface area with less than 2% residual shrinkage.

3. The apparatus as claimed in claim 2 with:

the twin belts of the first shrinkage compactor made of rubber;

the second shrinkage compactor including a stretchable felt belt on which the fabric web is compacted.

4. The apparatus as claimed in claim 2, wherein the path of the knitted fabric web is arranged to make a plurality of longitudinal passes to and fro through the dryer.

5. A method for controlling within acceptable limits residual shrinkage in garments to be made from a knitted web having two sides, the method comprising steps as follows:

passing the knitted fabric web continuously at a moisture content of from 65% to 15% by weight for shrinking through a first shrinkage compactor;

then maintaining the knitted fabric web in a relaxed condition free from longitudinal and transverse tension while passing it through a dryer and with the dryer being provided with a series of nozzles arranged above and below the fabric web in alternating format, for directing heated air onto either of the two sides of the knitted fabric web to cause the knitted fabric web to wave still in the relaxed condition to allow loops of knits to shorten as the knitted fabric web dries to a moisture content of from 10% to 0% by weight;

then continuing to maintain the knitted fabric web in the relaxed condition while passing the knitted fabric web at a moisture content of from 10% to 0% by weight through a second shrinkage compactor for final shrinking of the fabric to a desired weight per surface area with less than 2% residual shrinkage.

6. The method as claimed in claim 5, wherein the knitted fabric web is passed through the first shrinkage compactor at a moisture content of from 55% to 20% by weight.

7. The method as claimed in claim 5, and providing in the first shrinkage compactor twin rubber belts abutting one another to form a nip therebetween wherein the fabric web is compacted;

providing in the second shrinkage compactor a stretchable felt belt on which the knitted fabric web is compacted.

8. The method as claimed in claim 5, and arranging the knitted fabric web to make a plurality of longitudinal passes to and fro through the dryer.

9. Apparatus for controlling within acceptable limits residual shrinkage in garments to be made from a flattened knitted fabric tube having two sides, the apparatus comprising in combination:

input means for delivering the knitted fabric tube continuously at a moisture content of from 65% to 15% by weight to a first shrinkage compactor for shrinking therein;

dryer delivery means for delivering the knitted fabric tube in a relaxed condition free from longitudinal and transverse tension to a dryer which includes a housing, a source of heated air, ducting for delivering the heated air from the source of heated air to a series of nozzles, an exhaust means and an endless belt adapted to carry the knitted fabric tube in the relaxed condition along a path through the dryer to allow loops of knits to shorter and to dry the knitted fabric tube to a moisture content of from 10% to 0% by weight;

the series of nozzles arranged above and below the fabric tube in alternating format, thereby directing the heated air onto either side of the two sides of the knitted fabric tube to cause the knitted fabric tube to wave still in the relaxed condition;

conveying means for carrying the knitted fabric tube still in the relaxed condition from the dryer to a second shrinkage compactor, the second shrinkage compactor arranged for final shrinkage of the knitted fabric tube to a desired weight per surface area with less than 2% residual shrinkage.

10. Apparatus for controlling within acceptable limits residual shrinkage in garments to be made from a flattened knitted fabric tube having two sides, the apparatus comprising in combination:

input means for delivering the knitted fabric tube continuously at a moisture content of from 50% to 20% by weight to a first shrinkage compactor;

the first shrinkage compactor including twin belts abutting one another to form a nip therebetween wherein the fabric tube is compacted for initial shrinking;

dryer delivery means for delivering the knitted fabric tube to a dryer which includes a housing, a source of heated air, ducting for delivering the heated air from the source of heated air to a series of nozzles, exhaust means, and an endless belt adapted to carry the fabric tube in a relaxed condition free from longitudinal and transverse tension along a path through the dryer to allow loops of knits to shorten and to dry the knitted fabric web to a moisture content of from 10% to 0% by weight;

the series of nozzles arranged above and below the fabric web in alternating format, thereby directing the heated air onto either of the two sides of the knitted fabric web to cause the knitted fabric web to wave still in the relaxed condition;

conveying means for carrying the knitted fabric tube still in the relaxed condition from the dryer through a second shrinkage compactor;

the second shrinkage compactor arranged for final shrinking of the knitted fabric tube to a desired weight per surface area with less than 2% residual shrinkage.

11. The apparatus as claimed in claim 10, wherein the path of the knitted fabric tube is arranged to make a plurality of longitudinal passes to and fro through the dryer.

12. A method for controlling within acceptable limits residual shrinkage in garments to be made from a flattened knitted fabric tube having two sides, the method comprising steps as follows:

passing the knitted fabric tube continuously at a moisture content of from 65% to 15% by weight for shrinking through a first shrinkage compactor;

then maintaining the knitted fabric tube in a relaxed condition while passing it free from longitudinal and transverse tension through a dryer with the dryer being provided with a series of nozzles arranged above and below the fabric web in alternating format, thereby directing the heated air onto either of the two sides of the knitted fabric tube to cause the knitted fabric tube to wave still in the relaxed condition to allow loops of knits to shorten as the knitted fabric tube dries to a moisture content of from 10% to 0% by weight;

then continuing to maintain the knitted fabric tube in the relaxed condition while passing the knitted fabric tube at a moisture content of from 10% to 0% by weight through a second shrinkage compactor for final shrinking of the fabric to a desired weight per surface area with less than 2% residual shrinkage.

13. The method as claimed in claim 12, and arranging the knitted fabric tube to make a plurality of longitudinal passes to and fro through the dryer.

* * * * *